United States Patent [19]

Matsuoka et al.

[11] Patent Number: 4,793,401

[45] Date of Patent: Dec. 27, 1988

[54] METHOD OF PRODUCING THIN STEEL SHEETS HAVING AN IMPROVED PROCESSABILITY

[75] Inventors: Saiji Matsuoka; Susumu Satoh; Takashi Obara; Kozo Tsunoyama; Hideo Abe, all of Chiba, Japan

[73] Assignee: Kawasaki Steel Corporation, Kobe, Japan

[21] Appl. No.: 939,543

[22] Filed: Dec. 9, 1986

[30] Foreign Application Priority Data

| | | | |
|---|---|---|---|
| Dec. 12, 1985 | [JP] | Japan | 60-278019 |
| Dec. 12, 1985 | [JP] | Japan | 60-278020 |
| Dec. 12, 1985 | [JP] | Japan | 60-278021 |
| Dec. 12, 1985 | [JP] | Japan | 60-278022 |

[51] Int. Cl.[4] ..... B21B 1/46; B21B 13/22; B22D 11/12

[52] U.S. Cl. ..... 164/476; 29/527.7; 72/202; 164/417

[58] Field of Search ..... 164/476, 417; 29/527.7; 72/200, 202

[56] References Cited

U.S. PATENT DOCUMENTS

| | | | |
|---|---|---|---|
| 4,630,352 | 12/1986 | Ginzburg et al. | 164/417 X |
| 4,675,974 | 6/1987 | Connolly | 164/476 X |
| 4,698,897 | 10/1987 | Frommann et al. | 164/476 X |

FOREIGN PATENT DOCUMENTS

| | | |
|---|---|---|
| 0054172 | 6/1982 | European Pat. Off. . |
| 0099520 | 2/1984 | European Pat. Off. . |
| 0194118 | 9/1986 | European Pat. Off. . |
| 1236453 | 3/1967 | Fed. Rep. of Germany . |
| 2838095 | 5/1980 | Fed. Rep. of Germany . |
| 47-30809 | 8/1972 | Japan . |
| 59-101205 | 6/1984 | Japan . |
| 59-229413 | 12/1984 | Japan . |
| 60-108101 | 6/1985 | Japan . |
| 1247232 | 9/1971 | United Kingdom . |
| 2129723A | 5/1984 | United Kingdom . |

OTHER PUBLICATIONS

Steel in the USSR, vol. 9, No. 10, Oct. 1979, pp. 515–519.

Patent Abstracts of Japan, vol. 9, No. 261, Oct. 18, 1985 & JP-A-60 108 101.

Patent Abstracts of Japan, vol. 9, No. 146, Jun. 21, 1985 & JP-A-60 24201.

*Primary Examiner*—Fred A. Silverberg
*Assistant Examiner*—J. Reed Batten, Jr.
*Attorney, Agent, or Firm*—Balogh, Osann, Kramer, Dvorak, Genova & Traub

[57] ABSTRACT

Thin steel sheets having an improved processability are produced when a steel sheet or cast strip obtained through a continuous casting or strip caster process is subjected to a lubrication rolling step at a temperature of from $Ar_3$ transformation point to 300° C. and a rolling speed of not less than 1,500 m/min. By this method, the cold rolling step or cold rolling-annealing step can be omitted.

20 Claims, 17 Drawing Sheets

METHOD OF PRODUCING THIN STEEL SHEETS HAVING AN IMPROVED PROCESSABILITY

BACKGROUND OF THE INVENTION

1. Field of the Invention

This invention relates to a method of producing thin steel sheets having an improved processability.

2. Related Art Statement

Thin steel sheets having a thickness of not more than 6 mm and used for building materials, vehicle bodies for automobile, can materials, various surface treating black plates and so on are roughly divided into hot rolled steel sheet and cold rolled steel sheet.

Heretofore, these thin steel sheets are produced by the following general production steps:

At first, a steel slab of about 200 mm in thickness is produced by a continuous casting process or an ingot making-blooming process, and then hot rolled to a thickness of 2–6 mm. That is, the slab is subjected to a rough hot rolling to form a sheet bar of about 30 mm in thickness and further to a finish hot rolling to form a hot rolled steel sheet of 2–6 mm in thickness.

Furthermore, the hot rolled steel sheet is pickled, cold rolled to a given thickness, and subjected to a recrystallization treatment by box annealing or continuous annealing to form a cold rolled steel sheet.

In the above-mentioned conventional procedure for the production of the thin steel sheet, it is a greatest drawback that the production installation is enormous. Particularly, in the hot rolling step required for the production of hot rolled steel sheet and cold rolled steel sheet, 4–5 rough rolling machines are usually used at rough rolling stage and a tandem type rolling machine usually composed of 6–7 stands is used at finish hot rolling stage, so that the installation becomes necessarily enormous.

On the other hand, in the production of cold rolled steel sheets, the production step is a serious drawback to be lengthened. That is, the energy, labor and time required for obtaining the product become enormous, and also various problems are unfavorably caused in the quality of the product, particularly surface properties thereof at such a long step.

There have hitherto been proposed some technics on the production of the thin steel sheet. For instance, Japanese Patent laid open No. 47-30,809 discloses a hot rolling apparatus wherein a cooling device, a rolling roll and a coiler are arranged behind the usual finish hot rolling stand. According to this apparatus, the hot rolled steel sheet is continuously subjected to a low temperature hot rolling after the coiling, whereby a drawability equal to that of the cold rolled steel sheet is obtained even when omitting the cold rolling step. However, compact equipment and high productivity are not satisfied due to the use of the usual finish hot rolling stand.

In Japanese Patent laid open No. 59-101,205 is disclosed an apparatus for producing a hot rolled steel sheet from a continuously cast steel material wherein a shear, a coiling device, a heating furnace, a decoiling device, a coiling furnace, a rolling machine and a coiling device are arranged behind the continuous casting machine. According to this apparatus, however, the properties based on the omission of cold rolling step and annealing step are not attained because only the hot rolled steel sheet is produced.

In Japanese Patent laid open No. 59-229,413, there is disclosed an apparatus for producing extra-fine ferrite steel wherein a rolling machine incorporated into a common housing and composed of an entry side roll set having a work roll diameter of 600 mm and an exit side roll set having a work roll diameter of 200 mm at a distance between the work rolls of 2,000 mm is arranged behind a continuous casting machine of small sectional area, and a salt bath and a coiler are arranged therebehind. However, only the hot rolled steel sheet is produced by this apparatus, so that it is impossible to omit the cold rolling step and cold rolling-annealing step. Further, it is difficult to obtain a uniform texture in the steel sheet.

In Japanese Patent laid open No. 60-108,101 is disclosed an apparatus for producing thin metal plates wherein a temperature adjusting device, a coil box, a hot rolling device and a coiler are arranged behind a continuous casting machine. However, only the hot rolled steel sheet is produced even by this apparatus, so that it is impossible to omit the cold rolling step and cold rolling-annealing step.

All of the aforementioned conventional technics are excellent as an apparatus for producing thin steel sheets, but do not satisfy all of the conditions such as omission of cold rolling step and cold rolling-annealing step, high productivity and compact equipment.

SUMMARY OF THE INVENTION

It is an object of the invention to provide a method of producing thin steel sheets having an improved processability with a higher productivity which can make the hot rolling step compact and omit the cold rolling step and cold rolling-annealing step.

According to the invention, there is the provision of a method of producing thin steel sheets having an improved processability, comprising a combination of steps selected from a combination of a continuous casting step, a rough rolling step and a lubrication rolling step at a temperature of from $Ar_3$ transformation point to 300° C. and a high rolling speed of not less than 1,500 m/min; a combination of a continuous casting step, a rough rolling step, a finish hot rolling step and a lubrication rolling step at a temperature of from $Ar_3$ transformation point to 300° C. and a high rolling speed of not less than 1,500 m/min; a combination of a step of directly and continuously producing a strip of not more than 50 mm in thickness from molten steel through a strip caster process and a lubrication rolling step at a temperature of from $Ar_3$ transformation point to 300° C. and a high rolling speed of not less than 1,500 m/min; a combination of a step of directly and continuously producing a strip of not more than 50 mm in thickness from molten steel through a strip caster process, a finish hot rolling step and a lubrication rolling step at a temperature of from $Ar_3$ transformation point to 300° C. and a high rolling speed of not less than 1,500 m/min; a combination of a continuous casting step, a rough rolling step, a lubrication rolling step at a temperature of from $Ar_3$ transformation point to 300° C. and a high rolling speed of not less than 1,500 m/min and an annealing step; a combination of a continuous casting step, a rough rolling step, a finish hot rolling step, a lubrication rolling step at a temperature of from $Ar_3$ transformation point to 300° C. and a high rolling speed of not less than 1,500 m/min and an annealing step; a combination of a step of directly and continuously producing a strip of not more than 50 mm in thickness from molten steel through a strip caster process, a lubrication rolling step at a temperature of from $Ar_3$ transformation point to 300° C. and a high rolling speed of not less than 1,500 m/min and an annealing step; and a combination of a step of directly and continuously producing a strip of not more than 50 mm in thickness from molten steel through a strip caster process, a finish hot rolling step, a lubrication rolling step at a temperature of from $Ar_3$ transformation point to 300° C. and a high rolling speed of not less than 1,500 m/min and an annealing step.

In the preferred embodiment of the invention, the hot rolling is carried out at attemperature of from 1,100° C. to 700° C. under such a strong lubrication that a reduction rate of rolling load is not less than 30%, or a coil box is arranged behind the rough rolling step or the continuously strip producing step through the strip caster process, or a cooling device is arrnnged between the finish hot rolling step and the lubrication rolling step or between the lubrication rolling step and the annealing step, or a coiler is arranged just after the lubrication rolling step, or a proximity coiler for taking up a steel sheet rolled at the lubrication rolling step so as to reduce the temperature drop of the steel sheet and an insulation box for maintaining the taken-up seeel sheet within a temperature range of 750°–600° C. for a given time are arranged behind the lubrication rolling step, or a sheet material decoiled from the coil box is joined by a sheet bar joining machine.

BRIEF DESCRIPTION OF THE DRAWINGS

The invention will be described with reference to the accompanying drawings, wherein.

DESCRIPTION OF THE PREFERRED EMBODIMENTS

Figure 1:
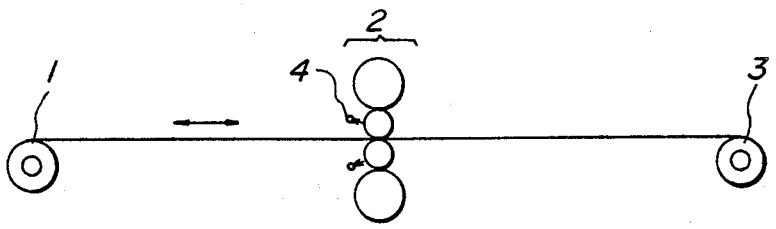
FIG. 1 is an elevational view of a first embodiment of the apparatus for producing the thin steel sheet according to the invention.

Heretofore, the greater part of hot rolling has been carried out under no lubrication. Although the lubrication rolling has been rarely performed, the lubrication effect was small and the reduction rate of rolling load based on the lubrication rolling was about 10–15% at most. As a result of various studies, the inventors have found that the rolling is made possible at such a state that the friction coefficient is not more than 0.3 by subjecting to a strong lubrication rolling at a reduction rate of rolling load of not less than 30%. Further, it has been found that when the rolling load is reduced to not less than 30% by the strong lubrication, the draft per stand may be raised and the number of stands in the finish hot rolling machine may be decreased from the usually required 6–7 stands to 1–4 stands and in this case the shape and properties of the resulting sheet become good. Moreover, it has been confirmed that the above strong lubrication rolling not only makes possible the above large draft rolling but also may uniformly apply the rolling strain to the central portion of the steel sheet to break the cast texture, whereby steel sheets required for the production of this steel sheets having an improved processability can be supplied to the subsequent step.

According to the invention, therefore, the hot rolling step may be made compact by the adoption of a large draft rolling machine provided with a lubrication means.

In the conventional hot rolling, the rolling rate is about 1,500 m/min at maximum, which is fairly lower than the rolling rate in cold rolling of about 2,500 m/min, while according to the invention a rolling machine capable of stably rolling at a high speed of not less than 1,500 m/min is used. That is, according to the invention, thin steel sheets having improved ridging resistance and processability can be produced with the omission of cold rolling step or cold rolling-annealing step by performing high speed lubrication rolling within a warm temperature range of from $Ar_3$ transformation point to 300° C. as proposed in Japanese Patent laid open Nos. 61-204,320 and 61-204,336 and the like. The lubrication effect in the high speed warm rolling lies in that the rolling strain is effectively and uniformly applied to the central portion of the steel sheet to form a microstructure useful for the improvement of processability. This is due to the fact that after the high rolling strain is uniformly introduced into the steel sheet by high speed warm lubrication rolling for a short time, the recrystallization is immediately caused to provide such an effect that the strain-annealing step will proceed at once. In the conventional low speed rolling, the release of strain is faster than the introduction of strain, so that a good processability is not obtained. Furthermore, in the conventional high temperature rolling above $Ar_3$ transformation point, even when performing the high speed lubrication rolling, the effect of getting from strain storage to self-annealing as in the invention can not be expected completely.

The invention will be described in detail with respect to the following embodiments.

The invention is enforced by using a large draft rolling machine provided with a lubrication means for rolling a continuously cast slab at a temperature of 1,100°-700° C. under such a high lubrication that the reduction rate of rolling load is not less than 30%. That is, the large draft rolling machine provided with the lubrication means is necessary for rolling the cast strip or steel sheet of large thickness in a compact equipment, but the structure thereof is not so important in the invention and is enough to include a device for jetting a lubricating oil, whereby the rolling at a large draft of not less than 90% is attained. The rolling rolls per stand may be two-high, four-high or six-high, and the number of stands may be 1-4. Further, the work roll diameter, distance between work rolls in case of two or more work rolls and material of the work roll may be optional. The application of lubricating oil may be performed by jetting on the work roll or backup roll. In this case, the lubricating oil and water may be applied separately or in admixture. The jetting amount of the lubricating oil and the jetting device are also optional. In the large draft rolling machine provided with the lubrication means, the service temperature is within a range of 1,100°-700° C., which is substantially the same as in the usual hot rolling machine.

In the practice of the invention, a high speed rolling machine provided with a lubrication means is used for lubrication-rolling the aforementioned strongly lubrication rolled steel sheet at a temperature of from $Ar_3$ transformation point to 300° C. and a high rolling speed of not less than 1,500 m/min. That is, the use of the high speed rolling machine provided with the lubrication means is required to omit the cold rolling step as well as the cold rolling-annealing step and ensure the high productivity, but the structure thereof is not so important in the invention. Therefore, any machines satisfying a rolling speed of 1,500 to 5,000 m/min and provided with a means for jetting a lubricating oil may be used. Further, the rolling rolls per stand may be two-high, four-high or six-high, and the number of stands may be 1-4. Moreover, the work roll diameter, distance between work rolls in case of two or more work rolls and material of the work roll are optional. The service temperature in the high speed rolling machine provided with the lubrication means is within a range of from $Ar_3$ transformation point to 300° C., which is essentially different from the temperature of less than 300° C. in the cold rolling. The application of the lubricating oil is the same as previously mentioned.

Furthermore, in the invention, it is essential to use a cooling means in order to control the temperature of the steel sheet rolled in the large draft rolling machine provided with the lubrication means. That is, the steel sheet rolled in such a large draft rolling machine has a temperature of 1,000°-700° C., while the rolling temperature in the subsequent high speed rolling machine provided with the lubrication means is $Ar_3$ transformation point to 300° C., so that it is required to cool the steel sheet between the large draft rolling machine and the high speed rolling machine for ensuring the properties of the steel sheet. The structure of the cooling means is substantially the same as that arranged on a runout table in the usual hot rolling equipment. The cooling is carried out with water, and the way of jetting water is optional, and the jetting amount can optionally be controlled in accordance with the temperature drop amount of the steel sheet.

The proximity coiler is required in order that the thin steel sheet rolled in the high speed rolling machine is taken up at a temperature enough to perform the self-annealing of the thin steel sheet, but its structure is the same as in the usual coiler because it is not so important in the invention. The distance between the high speed rolling machine and the proximity coiler is preferably within 20 m.

The thin steel sheet taken up on the proximity coiler is housed in an insulation box held within a temperature range of 750°-600° C. for a given time in order to reduce the temperature drop after the coiling or somewhat heat the thin steel sheet. As the insulation box, any structure may be taken so far as the coiled sheet is maintained at a temperature of 750°-600° C. for a given time. Moreover, it is possible to adjust the atmosphere inside the insulation box, and also a means for the control of scale formation or the formation of tight scale after the coiling may be applied.

According to the invention, the steel sheet or cast strip to be fed into the large draft rolling machine may be produced by any known methods. For example, the slab of about 260 mm in thickness produced by the usual continuous casting machine may be made into a sheet bar of 10-50 mm in thickness by a rough rolling machine, or a sheet bar of 5-50 mm in thickness may directly be produced from molten steel through a strip caster process (sheet bar caster process) using a continuously casting equipment having a pair of steel belts cooled at their back surface with water.

Furthermore, the temperature of the sheet material to be subjected to hot rolling can uniformly be maintained in the coil box, whereby the large draft rolling uniformly applying the rolling strain is made possible in the large draft rolling machine continued from the coil box under a state of saving heat energy applied to the sheet material. And also, a relatively low casting speed at upstream side can completely be separated from a relatively high rolling speed by the coil box, and the steel sheet or cast strip produced by the casting equipment of two or more strands may be rolled by means of one equipment row.

The thin steel sheet decoiled from the coil box is joined by means of a sheet bar joining machine. Such a sheet bar joining makes possible to attain the continuation of subsequent rolling step. The way for joining the sheet bar may optionally be selected from laser welding, resistance welding and the like.

Moreover, the steel sheet or cast strip may be shaped into a thin steel sheet of 2–6 mm in thickness by means of a compact rolling machine having 1–4 stands or a Sendzimir type or roll cast type planetary mill before the high speed rolling machine.

Figure 2:
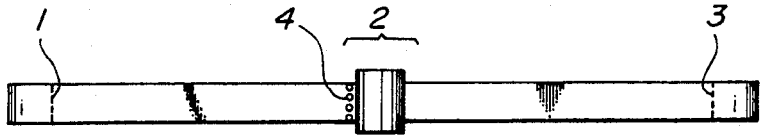
FIG. 2 is a plan view of FIG. 1.

In FIGS. 1 and 2 is shown a first embodiment of the apparatus for the production of thin steel sheets according to the invention, wherein each of numerals 1 and 3 is a mandrel type coiler Numeral 2 is a reverse-type high speed rolling machine provided with a lubrication means, which has a capacity of attaining a rolling speed up to 5,000 m/min at maximum and may perform low speed rolling. Numeral 4 is a device for jetting a lubricating oil.

The operation of the first embodiment will be described below. A steel sheet or cast strip is continuously fed to the high speed rolling machine 2. The steel sheet or cast strip is obtained by shaping a slab cast from a continuous casting machine into a sheet bar of 10–50 mm in thickness through a rough rolling machine.

The steel sheet or cast strip fed into the high speed rolling machine 2 is rolled several times to obtain a thih steel sheet having a given thickness.

The coilers 1 and 3 are used in the coiling and decoiling when the steel sheet is subjected to repeated rolling. Moreover, tension rolling may be performed by using these coilers. A mixed solution of the lubricating oil and water is jetted from the device 4 to a work roll, wherein a jetting nozzle is arranged so as to uniformly apply the lubricating oil to the surface of the work roll.

Figure 3:
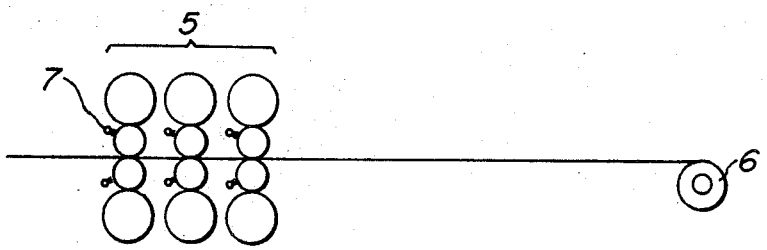
FIG. 3 is an elevational view of a second embodiment of the apparatus for producing the thin steel sheet according to the invention.
Figure 4:
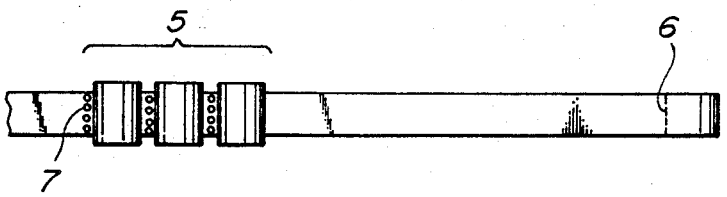
FIG. 4 is a plan view of FIG. 3.

In FIGS. 3 and 4 is shown a second embodiment of the apparatus for the production of thin steel sheets according to the invention. Numeral 5 is a high speed rolling machine provided with a lubrication means and is a tandem type three four-high stands. In the high speed rolling machine 5, the rolling speed at third stand is made possible to be 5,000 m/min at maximum, and also low speed rolling may be performed. Further, tension rolling can be carried out between the stands. Moreover, numeral 6 is a mandrel type coiler, and numeral 7 a device for jetting a lubricating oil.

The operation of the second embodiment will be described below. A steel sheet or cast strip is continuously fed to the high speed rolling machine 5. The steel sheet or cast strip is obtained by shaping a slab cast from a continuous casting machine into a sheet bar of 10–50 mm in thickness through a rough rolling machine, or by producing a sheet bar of 5–50 mm in thickness through a sheet bar caster.

The steel sheet or cast strip fed into the high speed rolling machine 5 is rolled at three stands to obtain a thin steel sheet having a given thickness. The thus rolled thin steel sheet is taken up on the coiler 6.

In the device 7, the lubricating oil and water are separately supplied to a jetting nozzle, from which they are jetted together to a work roll. In this case, the jetting nozzle is arranged so as to uniformly apply the mixed solution to the surface of the work roll.

As described on the first and second embodiments according to the invention, the use of the high speed rolling machine provided with the lubrication means can omit the cold rolling step or cold rolling-annealing step in the production of processable thin steel sheets made from low carbon steel, stainless steel or the like. Further, the high productivity of the thin steel sheet can be obtained because of the high speed rolling. Moreover, since the rolling load is reduced owing to the lubrication rolling, the energy-saving and the compactness of the equipment are accomplished and the surface properties of the thin steel sheet are improved.

Figure 5:
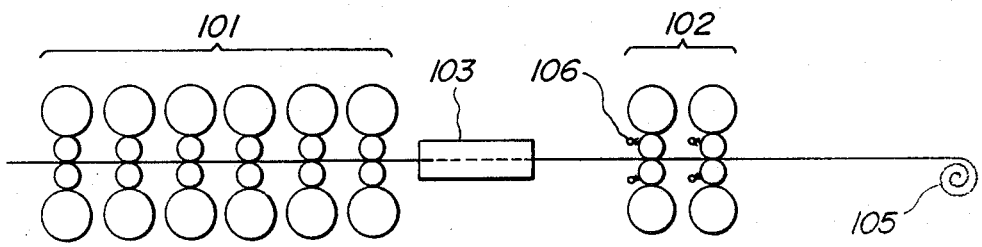
FIG. 5 is an elevational view of a third embodiment of the apparatus for producing the thin steel sheet according to the invention.
Figure 6:
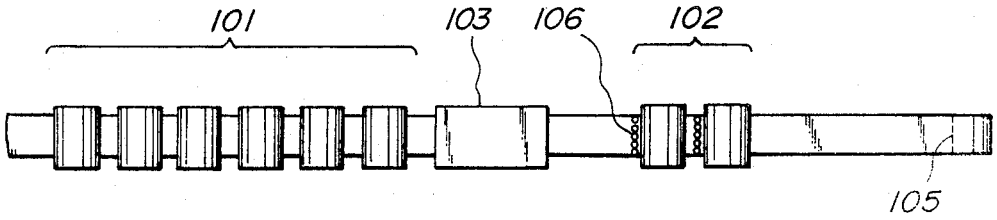
FIG. 6 is a plan view of FIG. 5.

In FIGS. 5 and 6 is shown a third embodiment of the apparatus for the production of thin steel sheets according to the invention, wherein numeral 101 is a continuously hot rolling machine usually comprised of six four-high stands, numeral 102 a high speed rolling machine provided with a lubrication means, which is capable of rolling at a rolling speed of up to 5,000 m/min at maximum and may perform low speed rolling, numeral 103 a cooling device through water jetting, numeral 105 a coiler and numeral 106 a device for jetting a lubricating oil.

The operation of the third embodiment will be described below. A steel sheet or cast strip is continuously fed to the hot rolling machine 101. The steel sheet or cast strip is obtained by shaping a slab cast from a continuous casting machine into a sheet bar of 10–50 mm in thickness through a rough rolling machine or by producing a sheet bar of 5–50 mm in thickness through a sheet bar caster.

A steel sheet rolled to a thickness of 2–6 mm in the hot rolling machine is cooled to a given temperature in the cooling device 103 and then continuously fed into the high speed rolling machine 102.

In the high speed rolling machine 102, the steel sheet is rolled at two four-high stands to obtain a high-grade hot rolled or processable thin steel sheet having a given thickness. In this case, tension rolling may be performed between the stands. The thus rolled thin steel sheet is taken up on the coiler 105.

In the device 106, the lubricating oil and water are separately supplied to a jetting nozzle, from which the mixed solution is jetted to a work roll. In this case, the jetting nozzle is arranged so as to uniformly apply the lubricating oil to the surface of the work roll.

Figure 7:
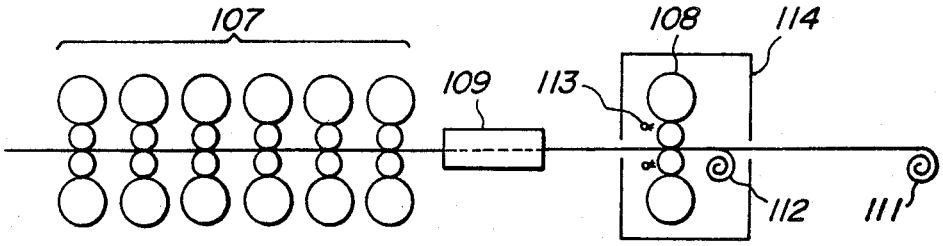
FIG. 7 is an elevational view of a fourth embodiment of the apparatus for producing the thin steel sheet according to the invention.
Figure 8:
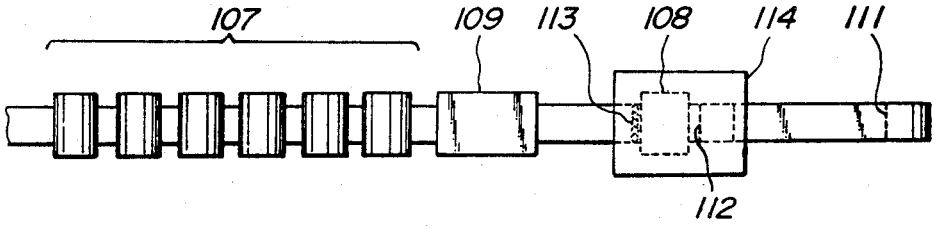
FIG. 8 is a plan view of FIG. 7.

In FIGS. 7 and 8 is shown a fourth embodiment of the apparatus for the production of thin steel sheets according to the invention, wherein numeral 107 is a hot rolling machine of tandem type six four-high stands. Numeral 108 is a high speed rolling machine provided with a lubrication means, which is capable of rolling at a rolling speed up to 5,000 m/min at maximum and may perform low speed rolling. Further, numeral 109 is a cooling device through water jetting, numeral 111 a coiler, numeral 112 a proximity coiler, numeral 113 a device for jetting a lubricating oil, and numeral 114 an atmosphere controlling cover.

The operation of the fourth embodiment will be described below. That is, a steel sheet or cast strip is continuously fed to the hot rolling machine 107. The steel sheet or cast strip is obtained by shaping a slab cast from a continuous casting machine into a sheet bar of 10–50 mm in thickness through a rough rolling machine, or by producing a sheet bar of 5–50 mm in thickness through a sheet bar caster.

The resulting steel sheet of 2–6 mm in thickness rolled in the hot rolling machine 107 is cooled to a given temperature at the cooling device 109 and then continuously fed into the high speed rolling machine 108.

In the high speed rolling machine 108, the steel sheet is rolled at one four-high stand to obtain a high-grade hot rolled or processable thin steel sheet having a given thickness.

The thus rolled thin steel sheet is taken up on the proximity coiler 112 to conduct self-annealing when it is used as a processable thin steel sheet with the omission of cold rolling-annealing step. Alternatively, the thin steel sheet is taken up on the coiler 111.

Since the thin steel sheet taken up on the proximity coiler 112 acts the self-annealing, the sheet temperature is high and the formation amount of scale is large. However, the interior of the atmosphere controlling cover 114 is $N_2$ gas atmosphere, so that the scale formation can be controlled.

A mixed solution of the lubricating oil and water is jetted from the nozzle of the device 113 to a work roll. In this case, the nozzle is arranged so as to uniformly apply the lubricating oil to the surface of the work roll.

Figure 9:
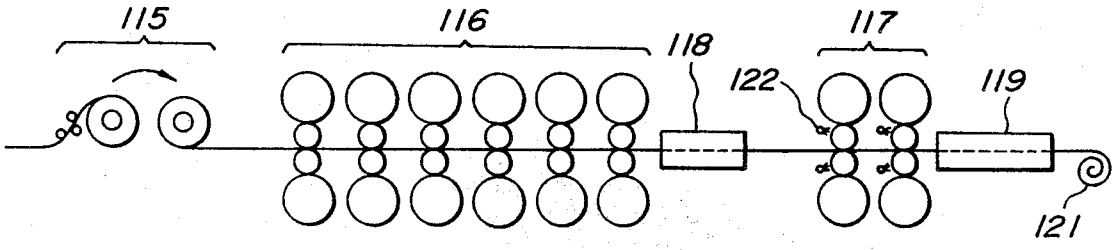
FIG. 9 is an elevational view of a fifth embodiment of the apparatus for producing the thin steel sheet according to the invention.
Figure 10:
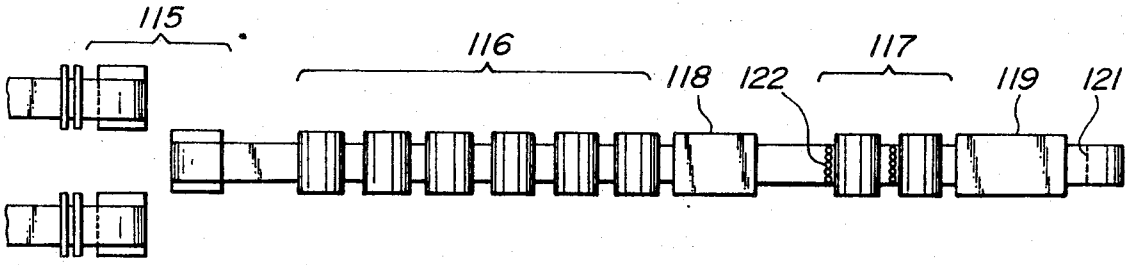
FIG. 10 is a plan view of FIG. 9.

In FIGS. 9 and 10 is shown a fifth embodiment of the apparatus for the production of thin steel sheets according to the invention. Numeral 115 is a coil box, at where a sheet bar of 5–50 mm in thickness is taken up on a coil to conduct uniformization of temperature in the coiled sheet bar. Numeral 116 is a hot rolling machine of six four-high stands, and numeral 117 a high speed rolling machine provided with a lubrication means, which is capable of rolling at a rolling speed of up to 5,000 m/min at maximum and may perform low speed rolling. Further, each of numerals 118 and 119 is a cooling device through water jetting, and numeral 121 a coiler.

The operation of the fifth embodiment will be described below. That is, a steel sheet or cast strip is continuously fed to the coil box 115. The steel sheet or cast strip is obtained by shaping a slab cast from a continuous casting machine into a sheet bar of 10–50 mm in thickness through a rough rolling machine, or by producing a sheet bar of 5–50 mm in thickness through a sheet bar caster of two strands.

In the coil box 115, the coiled sheet bar is little in the temperature drop and has a uniform temperature distribution. Such a coiled sheet bar is then fed into the subsequent hot rolling machine 116.

The resulting steel sheet of 2–6 mm in thickness rolled in the hot rolling machine 116 is cooled to a given temperature at the cooling device 118 and then continuously fed into the high speed rolling machine 117.

In the high speed rolling machine 117, the steel sheet is rolled at two four-high stands to obtain a high-grade hot rolled or processable thin steel sheet having a given thickness. In this case, tension rolling may be prformed between the two stands. The thus rolled thin steel sheet is cooled to a given temperature at the cooling device 119 and then taken up on the coiler 121.

In the device 122, the lubricating oll and water are separately supplied to a jetting nozzle, from which they are jetted together to a work roll. In this case, the nozzle is arranged so as to uniformly apply the lubricating oil to the surface of the work roll.

Figure 11:
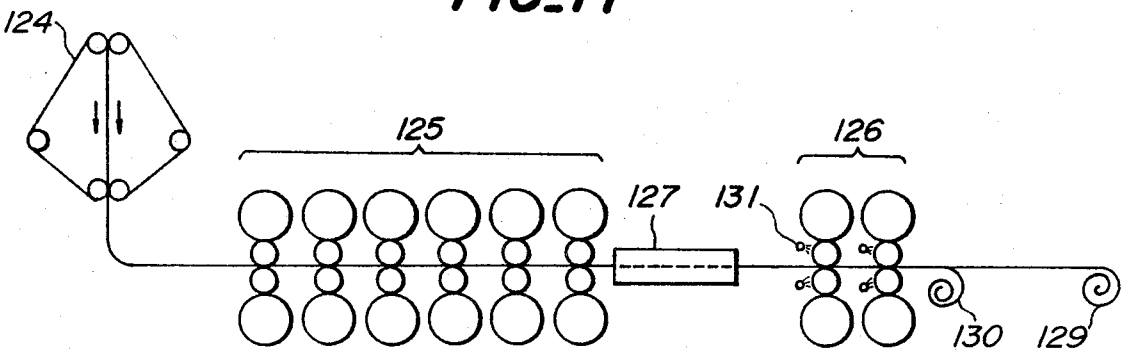
FIG. 11 is an elevational view of a sixth embodiment of the apparatus for producing the thin steel sheet according to the invention.
Figure 12:
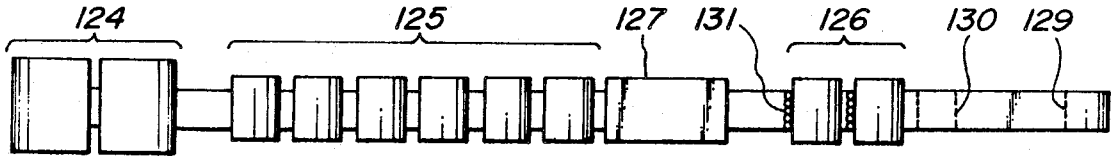
FIG. 12 is a plan view of FIG. 11.

In FIGS. 11 and 12 is shown a sixth embodiment of the apparatus for the production of thin steel sheets according to the invention. Numeral 124 is a continuous casting apparatus comprising a pair of endless steel belts each cooled at its surface with water. These belts are vertically or slantly arranged side by side at a gap corresponding to a thickness of a steel sheet or cast strip to be cast and synchronously moved in a direction of arrow by means of a driving device (not shown). Further, numeral 125 is a hot rolling machin of six four-high stands, numeral 126 a high speed rolling machine provided with a lubrication means, which is capable of rolling at a rolling speed of up to 5,000 m/min at maximum and may perform low speed rolling, numeral 127 a cooling device through water jetting, numeral 129 a coiler, numeral 130 a proximity coiler, and numeral 131 a device for jetting a lubricating oil.

The operation of the sixth embodiment will be described below. That is, a steel sheet or cast strip of 5–50 mm in thickness cast from the continuous casting apparatus 124 is continuously fed to the hot rolling machine 125. The steel sheet or cast strip may be cut at a proper length by means of a shear, if necessary.

The resulting steel sheet of 2–6 mm in thickness rolled in the hot rolling machine 125 is cooled to a given temperature at the cooling device 127 and then continuously fed into the high speed rolling machine 126.

In the high speed rolling machine 126, the steel sheet is rolled at two four-high stands to obtain a high-grade hot rolled or processable thin steel sheet having a given thickness.

The thus rolled thin steel sheet is taken up on the proximity coiler 130 to conduct self-annealing when it is used as a processable thin steel sheet with the omission of cold rolling-annealing step. Alternatively, the thin steel sheet is taken up on the coiler 129.

A mixed solution of the lubricating oil and water is jetted from the nozzle of the device 131 to a work roll. In this case, the nozzle is arranged so as to uniformly apply the lubricating oil to the surface of the work roll.

Figure 13:
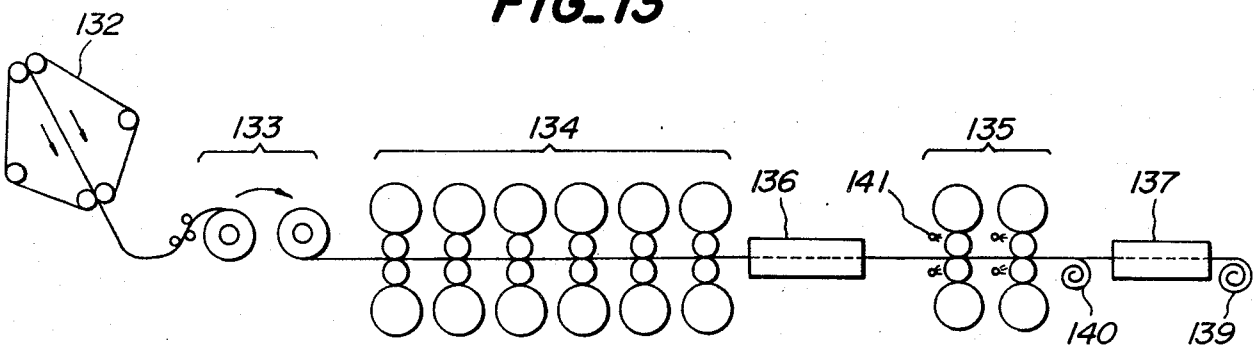
FIG. 13 is an elevational view of a seventh embodiment of the apparatus for producing the thin steel sheet according to the invention.
Figure 14:
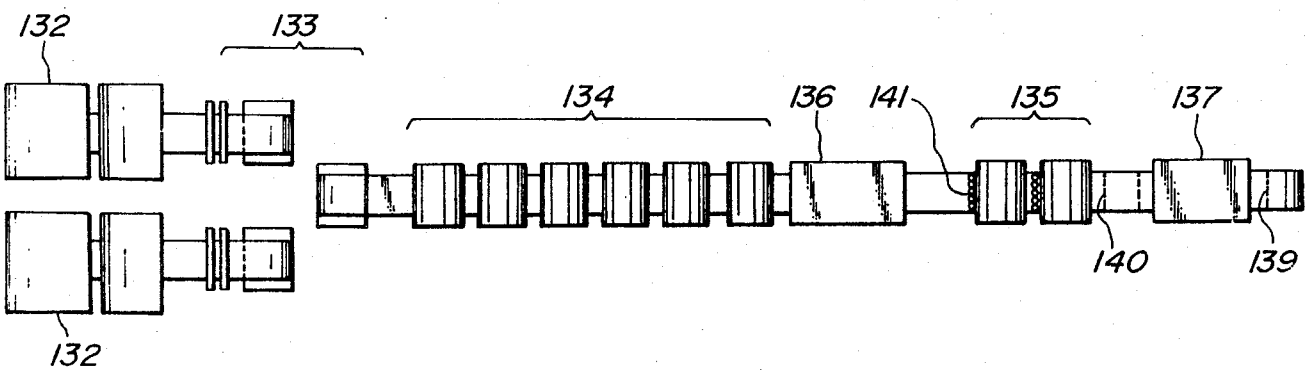
FIG. 14 is a plan view of FIG. 13.

In FIGS. 13 and 14 is shown a seventh embodiment of the apparatus for the production of thin steel sheets according to the invention. Numeral 132 is a continuous casting apparatus comprising a pair of endless steel belts each cooled at its surface with water. These belts are vertically or slantly arranged side by side at a gap corresponding to a thickness of a steel sheet or cast strip to be cast and synchronously moved in a direction of arrow by means of a driving device (not shown). Further, numeral 133 is a coil box, at where a sheet bar of 5–50 mm in thickness is taken up on a coil to conduct uniformization of temperature in the coiled sheet bar. Numeral 134 is a hot rolling machine of six four-high stands, numeral 135 a high speed rolling machine provided with a lubrication means, which is capable of rolling at a rolling speed of up to 5,000 m/min at maximum and may perform low speed rolling, each of numerals 136 and 137 a cooling device through water jetting, numeral 139 a coiler, numeral 140 a proximity coiler, and numeral 141 a device for jetting a lubricating oil.

The operation of the seventh embodiment will be described below. That is, a steel sheet or cast strip of 5–50 mm in thickness cast from the continuous casting apparatus 132 is continuously fed to the coil box 133. In this case, two coil boxes 133 (one of which is shown) are used because the continuous casting apparatus 132 comprises two strands. In the coil box 133, the coiled sheet bar is little in the temperature drop and has a uniform temperature distribution. Such a coiled sheet bar is then fed into the subsequent hot rolling machine 134.

The resulting steel sheet of 2–6 mm in thickness rolled in the hot rolling machine 134 is cooled to a given temperature at the cooling device 136 and then continuously fed into the high speed rolling machine 135.

In the high speed rolling machine 135, the steel sheet is rolled at two four-high stands to obtain a high-grade hot rolled or processable thin steel sheet having a given thickness.

The thus rolled thin steel sheet is taken up on the proximity coiler 140 to conduct self-annealing when it is used as a processable thin steel sheet with the omission of cold rolling-annealing step. Alternatively, the thin steel sheet is cooled to a given temperature at the cooling device 137 and then taken up on the coiler 139.

In the device 141, the lubricating oil and water are separately supplied to a jetting nozzle, from which they are jetted together to a work roll. In this case, the jetting nozzle is arranged so as to uniformly apply the lubricating oil to the surface of the work roll.

Figure 15:
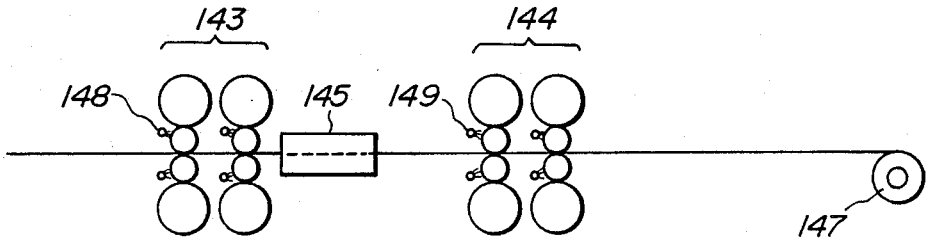
FIG. 15 is an elevational view of an eighth embodiment of the apparatus for producing the thin steel sheet according to the invention.
Figure 16:
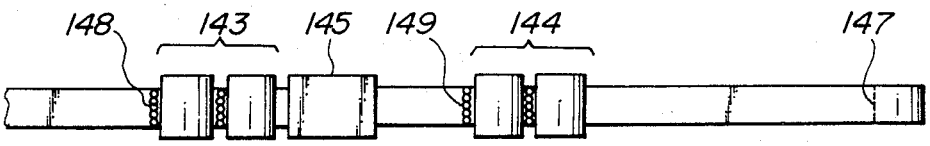
FIG. 16 is a plan view of FIG. 15.

In FIGS. 15 and 16 is shown an eighth embodiment of the apparatus for the production of thin steel sheets according to the invention, wherein numeral 143 is a large draft rolling machine of two four-high stands provided with a lubrication means and being capable of rolling at a draft of not less than 90%, and numeral 144 a high speed rolling machine provided with a lubrication means, which is capable of rolling at a rolling speed of up to 5,000 m/min at maximum and may perform low speed rolling. Further, numeral 145 is a cooling device through water jetting, numeral 147 a coiler, and each of numerals 148 and 149 a device for jetting a lubricating oil.

The operation of the eighth embodiment will be described below. That is, a steel sheet or cast strip is continuously fed to the large draft rolling machine 143. The steel sheet or cast strip is obtained by shaping a slab cast from a continuous casting machine into a sheet bar of 10–50 mm in thickness through a rough rolling machine, or by producing a sheet bar of 5–50 mm in thickness through a sheet bar caster.

The resulting steel sheet of 2–6 mm in thickness rolled in the large draft rolling machine 143 is cooled to a given temperatue at the cooling device 145 and then continuously fed into the high speed rolling machine 144.

In the high speed rolling machine 144, the steel sheet is rolled at two four-high stands to obtain a high-grade hot rolled or processable thin steel sheet having a gvven thickness. In this case, tension rolling may be performed between the two stands. The thus rolled thin steel sheet is taken up on the coiler 147.

In the device 148 and 149, the lubricating oil and water are separately supplied to a jetting nozzle, from which they are jetted together to a work roll. In this case, the jetting nozzle is arranged so as to uniformly apply the lubricating oil to the surface of the work roll.

According to the eighth embodiment of the invention, the large draft rolling machine is arranged before the high speed rolling machine and the cooling device is arranged therebetween, whereby the cold rolling step or cold rolling-annealing step can be omitted in the production of processable thin steel sheets made from low carbon steel, stainless steel or the like. Further, the high productivity of the thin steel sheet can be obtained because of the high speed rolling. Moreover, since the rolling load is reduced owing to the large draft lubrication rolling, the energy-saving and the compactness of the equipment are accomplished and the surface properties of the thin steel sheet are improved.

Figure 17:
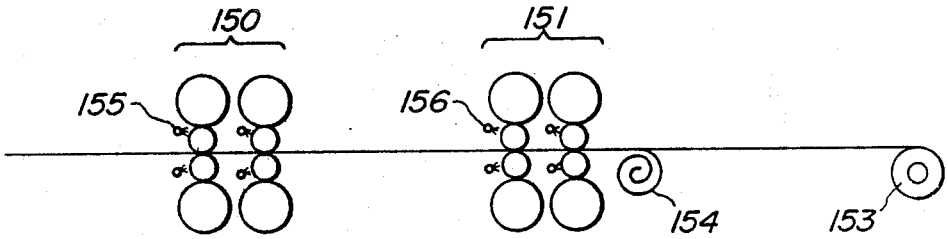
FIG. 17 is an elevational view of a ninth embodiment of the apparatus for producing the thin steel sheet according to the invention.
Figure 18:
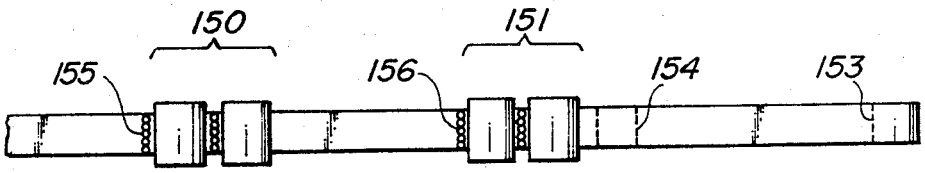
FIG. 18 is a plan view of FIG. 17.

In FIGS. 17 and 18 is shown a ninth embodiment of the apparatus for the production of thin steel sheets according to the invention, wherein numeral 150 is a large draft rolling machine of two four-high stands poovided with a lubrication means and being capable of rolling at a draf of not less than 90%, and numeral 151 a high speed rolling machine provided with a lubrication means, which is capable of rolling at a rolling speed of up to 5,000 m/min at maximum and may perform low speed rolling. Further, numeral 153 is a coiler, numeral 154 a proximity coiler, and each of numerals 155 and 156 a device for jetting a lubricating oil.

The operation of the ninth embodiment will be described below. That is, a steel sheet or cast strip is continuously fed to the large draft rolling machine 150. The steel sheet or cast strip is obtained by shaping a slab cast from a continuous casting machine into a sheet bar of 10–50 mm in thickness through a rough rolling machine, or by producing a sheet bar of 5–50 mm in thickness through a sheet bar caster.

The resulting steel sheet of 2–6 mm in thickness rolled in the large draft rolling machine 150 is continuously fed into the highsspeed rolling machine 151.

In the high speed rolling machine 151, the steel sheet is rolled at two four-high stands to obtain a high-grade hot rolled or processable thin steel sheet having a given thickness. In this case, tension rolling may be performed between the two stands.

The thus rolled thin steel sheet is taken up on the proximity coiler 154 to conduct self-annealing when it is used as a processable thin steel sheet with the omission of cold rolling-annealing step. Alternatively, the thin steel sheet is taken up on the coiler 153.

In the devices 155 and 156, the lubricating oil and water are separately supplied to a jetting nozzle, from which they are jetted together to a work roll. In this case, the jetting nozzle is arranged so as to uniformly apply the lubricating oil to the surface of the work roll.

Figure 19:
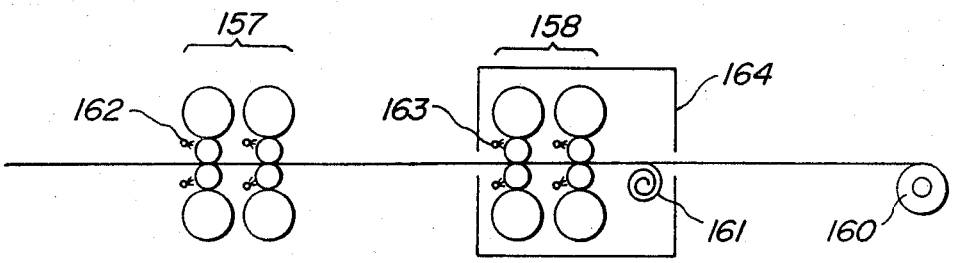
FIG. 19 is an elevational view of a tenth embodiment of the apparatus for producing the thin steel sheet according to the invention.
Figure 20:
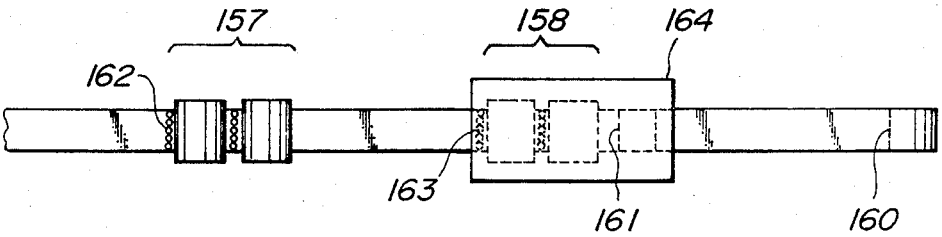
FIG. 20 is a plan view of FIG. 19.

In FIGS. 19 and 20 is shown a tenth embodiment of the apparatus for the production of thin steel sheets according to the invention, wherein numeral 157 is a large draft rolling machine of two four-high stands provided with a lubrication means and being capable of rolling at a draft of not less than 90%, and numeral 158 a high speed rolling machine provided with a lubrication means, which is capable of rolling at a rolling speed of up to 5,000 m/min at maximum and may perform low speed rolling. Further, numeral 160 is a coiler, numeral 161 a proximity coiler, each of numerals 162 and 163 a device for jetting a lubricating oil, and numeral 164 an atmosphere controlling cover having an inert gas therein.

The operation of the tenth embodiment will be described below. That is, a steel sheet or cast strip is continuously fed to the large draft rolling machine 157. The steel sheet or cast strip is obtained by shaping a slab cast from a continuous casting machine into a sheet bar of 10–50 mm in thickness through a rough rolling machine, or by producing a sheet bar of 5–50 mm in thickness through a sheet bar caster.

The resulting steel sheet of 2–6 mm in thickness rolled in the large draft rolling machine 157 is continuously fed into the high speed rolling machine 158.

In the high speed rolling machine 158, the steel sheet is rolled at two four-high stands to obtain a high-grade hot rolled or processable thin steel sheet having a given thickness. In this case, tension rolling may be performed between the two stands.

The thus rolled thin steel sheet is taken up on the proximity coiler 161 to conduct self-annealing when it is used as a processable thin steel sheet with the omission of cold rolling-annealing step. Alternatively, the thin steel sheet is taken up on the coiler 160.

Since the thin steel sheet taken up on the proximity coiler 161 acts the self-annealing, the sheet temperature is high and the formation amount of scale is large. However, the interior of the atmosphere controlling cover 164 is $N_2$ gas atmosphere, so that the scale formation can be controlled.

In the devices 162 and 163, the lubricating oil and water are separately supplied to a jetting nozzle, from which they are jetted together to a work roll. In this case, the jetting nozzle is arranged so as to uniformly apply the lubricating oil to the surface of the work roll.

According to the ninth and tenth embodiments of the invention, the large draft rolling machine is arranged before the high speed rolling machine and the proximity coiler is arranged just after the high speed rolling machine or the high speed rolling machine and proximity coiler are covered with the atmosphere controlling cover, whereby the cold rolling step or cold rolling-annealing step can be omitted in the production of processable thin steel sheets made from low carbon steel, stainless steel or the like. Further, the high productivity of the thin steel sheet can be obtained because of the high speed rolling. Moreover, since the rolling load is reduced owing to the lubrication large draft rolling, the energy-saving and the compactness of the equipment are accomplished and the surface properties of the thin steel sheet are improved.

Figure 21:
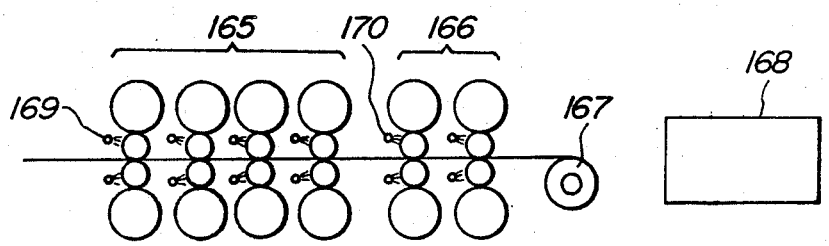
FIG. 21 is an elevational view of an eleventh embodiment of the apparatus for producing the thin steel sheet according to the invention.
Figure 22:
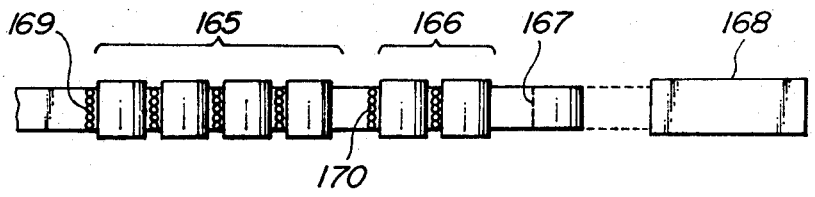
FIG. 22 is a plan view of FIG. 21.

In FIGS. 21 and 22 is shown an eleventh embodiment of the apparatus for the production of thin steel sheets according to the invention, wherein numeral 165 is a large draft rolling machine of four four-high stands provided with a lubrication means and being capable of rolling at a draft of not less than 90%, and numeral 166 a high speed rolling machine provided with a lubrication means, which is capable of rolling at a rolling speed of up to 5,000 m/min at maximum and may perform low speed rolling. Further, numeral 167 is a proximity coiler, numeral 168 an insulation box, and each of numerals 169 and 170 a device for jetting a lubricating oil.

The operation of the eleventh embodiment will be described below. That is, a steel sheet or cast strip is continuously fed to the large draft rolling machine 165. The steel sheet or cast strip is obtained by shaping a slab cast from a continuous casting machine into a sheet bar of 10–50 mm in thickness through a rough rolling machine, or by producing a sheet bar of 5–50 mm in thickness through a sheet bar caster.

The resulting steel sheet of 2–6 mm in thickness rolled in the large draft rolling machine 165 is continuously fed into the high speed rolling machine 166.

In the high speed rolling machine 166, the steel sheet is rolled at two four-high stands to obtain a high-grade hot rolled or processable thin steel sheet having a given thickness. In this case tension rolling may be performed between the two stands. The thus rolled thin steel sheet is taken up on the proximity coiler 167.

The thus coiled thin steel sheet is transferred to the insulation box 168 and held therein for a given time and then discharged therefrom. Moreover,the insulation box 168 may be heated to 600°–750° C. And also, a conveyor is arranged in the insulation box for successively transporting the coil from the box after a given time.

In the devices 169 and 170, the lubricating oil and water are separately supplied to a jetting nozzle, from which they are jetted together to a work roll. In this case, the jetting nozzle is arranged so as to uniformly apply the lubricating oil oo the surface of the work roll.

According to the eleventh embodiment of the invention, the large draft rolling machine 165 is arranged before the high speed rolling machine 166, whereby the cold rolling step or cold rolling-annealing step can be omitted in the production of processable thin steel sheets made from low carbon steel, stainless steel or the like. Further, the high productivity of the thin steel sheet can be obtained because of the high speed rolling. Moreover, since the rolling load is reduced owing to the lubrication rolling, the energy-saving and the compactness of the equipment are accomplished and the surface properties of the thin steel sheet are improved.

Figure 23:
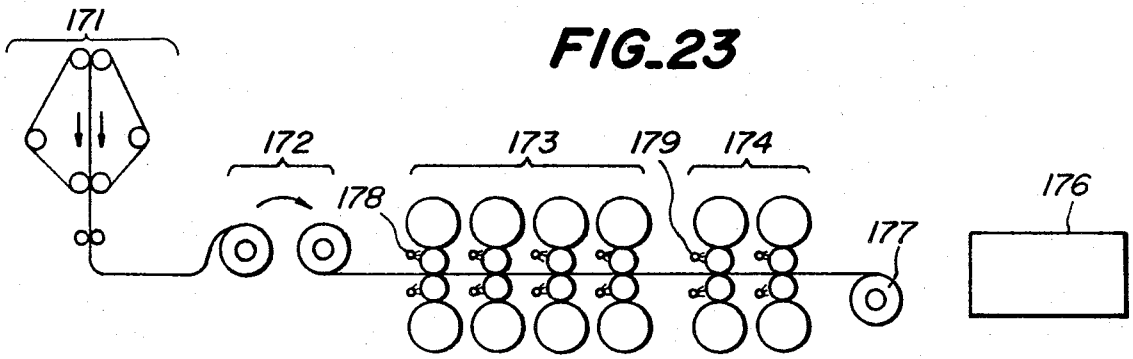
FIG. 23 is an elevational view of a twelfth embodiment of the apparatus for producing the thin steel sheet according to the invention.
Figure 24:
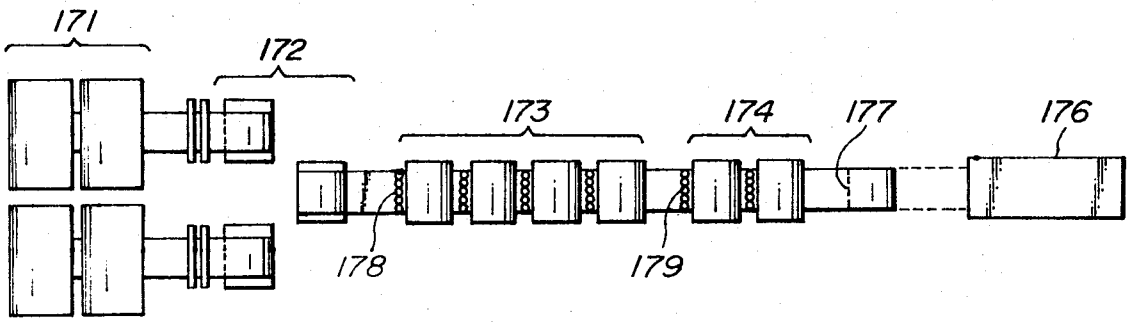
FIG. 24 is a plan view of FIG. 23.

In FIGS. 23 and 24 is shown a twelfth embodiment of the apparatus for the production of thin steel sheets according to the invention. Numeral 171 is a continuous casting apparatus comprising a pair of endless steel belts each cooled at its surface with water for a sheet bar caster process. These belts are vertically or slantly arranged side by side at a gap corresponding to a thickness of a steel sheet or cast strip to be cast and synchronously moved in a direction of arrow by means of a driving device (not shown). Further, numeral 172 is a coil box, at where a continuously cast strip is taken up on a coil to conduct uniformization of temperature in the strip. Moreover, numeral 173 is a large draft rolling machine of four four-high stands provided with a lubrication means and being capable of rolling at a draft of not less than 90%, and numeral 174 a high speed rolling machine provided with a lubrication means, which is capable of rolling at a rolling speed of up to 5,000 m/min at maximum and may perform low speed rolling. Further, numeral 177 is a coiler, numeral 176 an insulation box, and each of numerals 178 and 179 a device for jetting a lubricating oil.

The operation of the twelfth embodiment will be described below. That is, a steel sheet or cast strip of 5–50 mm in thickness cast from the continuous casting apparatus 171 is continuously taken up on the coil in the coil box 172. In the coil box 172, the coiled sheet bar is little in the temperature drop and has a uniform temperature distribution. Such a sheet bar is then fed to the subsequent large draft rolling machine 173. The resulting steel sheet of 2–6 mm in thickness rolled in the large draft rolling machine 173 is continuously fed into the high speed rolling machine 174.

In the high speed rolling machine 174, the steel sheet is rolled at two four-high stands to obtain a high-grade hot rolled or processable thin steel sheet having a given thickness. In this case, tension rolling may be performed between the two stands The thus rolled thin steel sheet is taken up on the coiler 177.

The thus coiled thin steel sheet is transferred to the insulation box 176, held therein at a temperature of 600°–750° C. for a given time and then discharged therefrom as a final product.

In the devices 178 and 179, the lubricating oil and water are separately supplied to a jetting nozzle, from which they are jetted together to a work roll. In this case, the jetting nozzle is arranged so as to uniformly apply the lubricating oil to the surface of the work roll.

According to the twelfth embodiment of the invention, the large draft rolling machine 173 and high speed rolling machine 174 are arranged behind the continuous casting apparatus 171 through the sheet bar caster process and the proximity coiler 177 and insulation box 176 are arranged therebehind, whereby the cold rolling step or cold rolling-annealing step can be omitted in the production of processable thin steel sheets made from low carbon steel, stainless steel or the like. Further, the high productivity of the thin steel sheet can be obtained because of the high speed rolling. Moreover, since the rolling load is reduced owing to the lubrication rolling, the energy-saving and the compactness of the equipment are accomplished and the surface properties of the thin steel sheet are improved.

Figure 25:
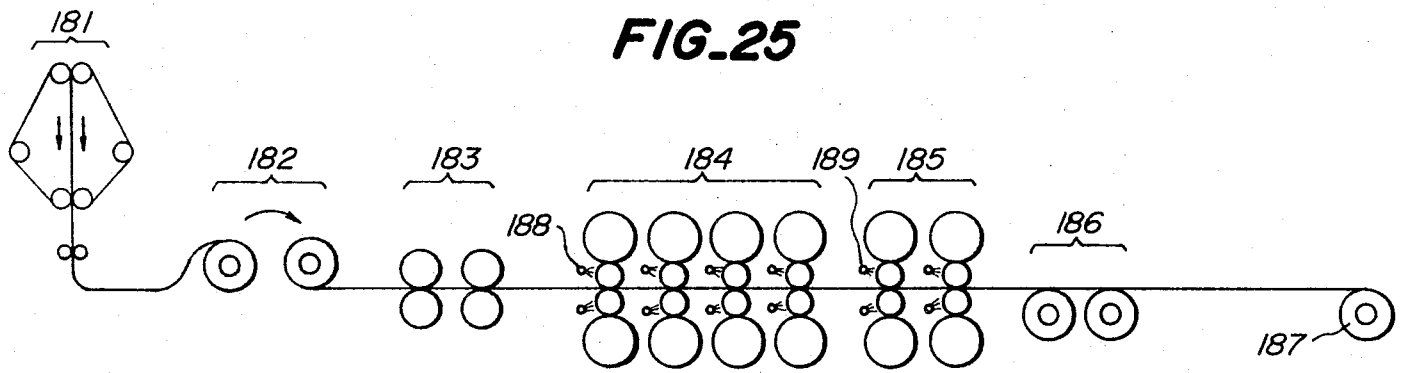
FIG. 25 is an elevational view of a thirteenth embodiment of the apparatus for producing the thin steel sheet according to the invention.
Figure 26:
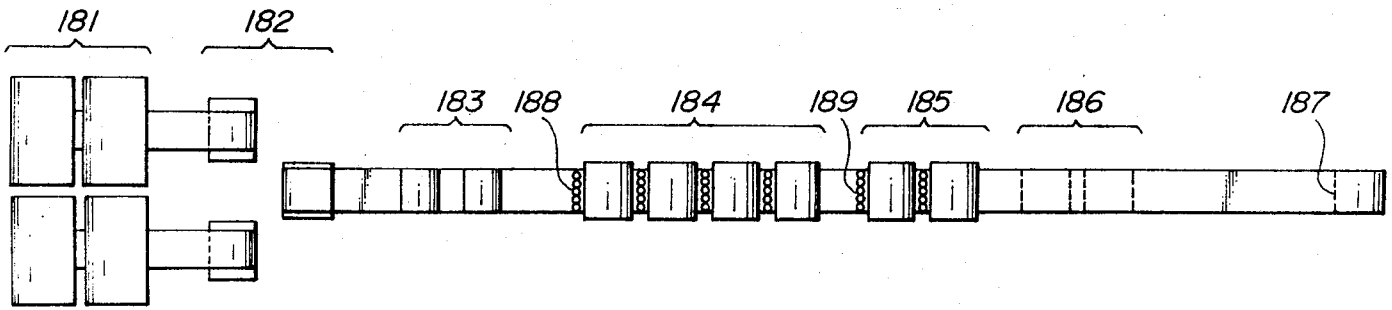
FIG. 26 is a plan view of FIG. 25.

In FIGS. 25 and 26 is shown a thirteenth embodiment of the apparatus for the production of thin steel sheets according to the invention, wherein numeral 181 is a continuous casting apparatus comprising a pair of endless steel belts each cooled at its surface with water for a sheet bar caster process. These belts are vertically or slantly arranged side by side at a gap corresponding to a thickness of a steel sheet or cast strip to be cast and synchronously moved in a direction of arrow by means of a driving device (not shown). The resulting steel sheet or cast strip is continuously fed to a coil box 182. In the coil box 182, the coiled sheet bar is little in the temperature drop and has a uniform temperature distribution. Such a coiled sheet bar is then fed to the subsequent sheet bar joining machine 183. As the sheet bar joining machine 183 is used, for example, a machine capable of welding steel sheets of not more than 50 mm in thickness to each other by resistance welding on a line. The welded steel sheet is continuously fed to a large draft rolling machine 184 provided with a lubrication means.

The large draft rolling machine 184 comprises four four-high stands capable of rolling at a draft of not less than 90%. Numeral 185 is a high speed rolling machine provided with a lubrication means, which is capable of rolling at a rolling speed of up to 5,000 m/min at maximum and may perform low speed rolling. Further, numerals 186 and 187 are coilers, and each of numerals 188 and 189 a device for jetting a lubricating oil.

The operation of the thirteenth embodiment will be described below. That is, the cast strip is continuously taken up on the coil in the coil box 182. The coiled strip is decoiled immediately or after held for a given time and then joined at the sheet bar joining machine 183, which is rolled endlessly. The resulting steel sheet of 2–6 mm in thickness rolled in the large draft rolling machine 184 is continuously fed into the high speed rolling machine 185.

In the high speed rolling machine 185, the steel sheet is rolled at two four-high stands to obtain a high-grade hot rolled or processable thin steel sheet having a given thickness. In this case, tension rolling may be performed between the two stands. The thus rolled thin steel sheet is taken up on the proximity coiler 186 without substantially causing temperature drop.

In the devices 188 and 189, the lubricating oil and water are separately supplied to a jetting nozzle, from which they are jetted together to a work roll. In this case, the jetting nozzle is arranged so as to uniformly apply the lubricating oil to the surface of the work roll.

According to the thirteenth embodiment of the invention, the large draft rolling machine 184 is arranged before the high speed rolling machine 185, whereby the cold rolling step or cold rolling-annealing step can be omitted in the production of processable thin steel sheets made from low carbon steel, stainless steel or the like. Further, the high productivity of the thin steel sheet can be obtained because of the high speed rolling. Moreover, since the rolling load is reduced owing to the lubrication rolling, the energy-saving and the compactness of the equimment are accomplished and the surface properties of the thin steel sheet are improved.

Figure 27:
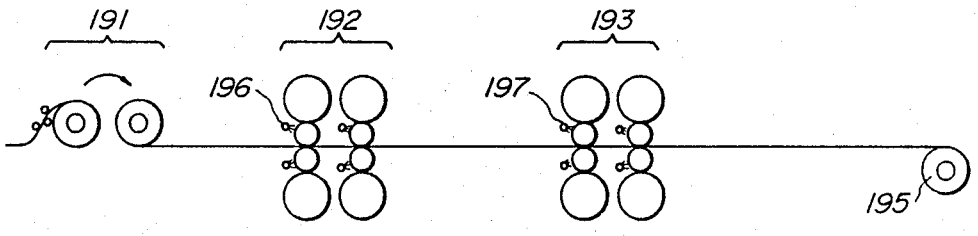
FIG. 27 is an elevational view of a fourteenth embodiment of the apparatus for producing the thin steel sheet according to the invention.
Figure 28:
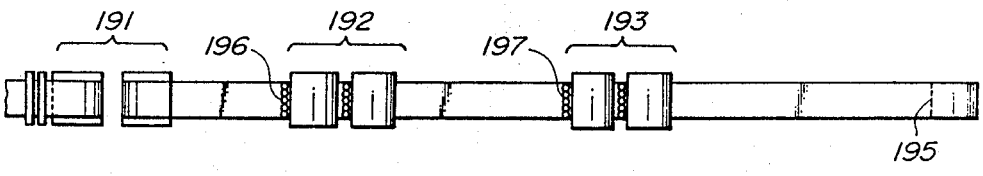
FIG. 28 is a plan view of FIG. 27.

In FIGS. 27 and 28 is shown a fourteenth embodiment of the apparatus for the production of thin steel sheets according to the invention, wherein numeral 191 is a coil box, at where a sheet bar of 5–50 mm in thickness is taken up on a coil to conduct uniformization of temperature in the sheet bar. Numeral 192 is a large draft rolling machine of two four-high stands provided with a lubrication means and being capable of rolling at a draft of not less than 90%, and numeral 193 a high speed rolling machine provided with a lubrication means, which is capable of rolling at a rolling speed of up to 5,000 m/min at maximum and may perform low speed rolling. Further, numeral 195 is a coiler, and each of numerals 196 and 197 a device for jetting a lubricating oil.

The operation of the fourteenth embodiment will be described below. That is, a steel sheet or cast strip is continuously fed to the coil box 191. The steel sheet or cast strip is obtained by shaping a slab cast from a continuous casting machine into a sheet bar of 10–50 mm in thickness through a rough rolling machine, or by producing a sheet bar of 5–50 mm in thickness through a sheet bar caster.

In the coil box 191, the sheet bar is little in the temperature drop and has a uniform temperature distribution, which is then fed to the subsequent large draft rolling machine 192.

The resulting steel sheet of 2–6 mm in thickness rolled in the large draft rolling machine 192 is continuously fed into the high speed rolling machine 193.

In the high speed rolling machine 193, the steel sheet is rolled at two four-high stands to obtain a high-grade hot rolled or processable thin steel sheet having a given thickness. In this case, tension rolling may be performed between the two stands. The thus rolled thin steel sheet is taken up on the coiler 195.

In the devices 196 and 197, the lubricating oil and water are separately supplied to a jetting nozzle, from which they are jetted together to a work roll. In this case, the jetting nozzle is arranged so as to uniformly apply the lubricating oil to the surface of the work roll.

Figure 29:
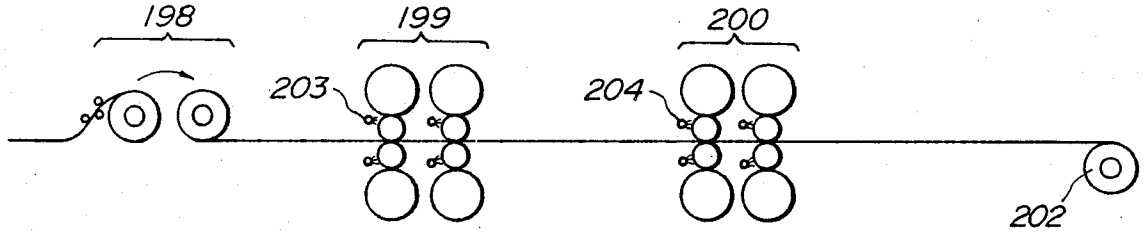
FIG. 29 is an elevational view of a fifteenth embodiment of the apparatus for producing the thin steel sheet according to the invention.
Figure 30:
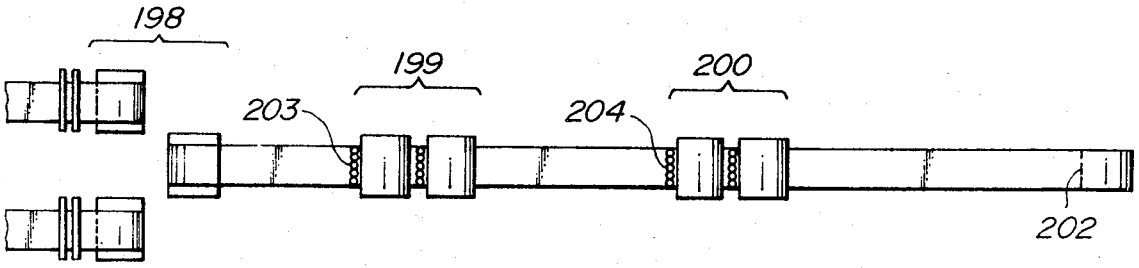
FIG. 30 is a plan view of FIG. 29.

In FIGS. 29 and 30 is shown a fifteenth embodiment of the apparatus for the production of thin steel sheets according to the invention, wherein numeral 198 is a coil box, at where a sheet bar of 5–50 mm in thickness is taken up on a coil to conduct uniformization of temperature in the sheet bar. Numeral 199 is a large draft rolling machine of two four-high stands provided with a lubrication means and being capable of rolling at a draft of not less than 90%, and numeral 200 a high speed rolling machine provided with a lubrication means, which is capable of rolling at a rolling speed of up to 5,000 m/min at maximum and may perform low speed rolling. Further, numeral 202 is a coiler, and each of numerals 203 and 204 a device for jetting a lubricating oil.

The operation of the fifteenth embodiment will be described below. That is, a steel sheet or cast strip is continuously fed to the coil box 198. The steel sheet or cast strip is obtained by shaping a slab cast from a continuous casting machine of two strands into a sheet bar of 10–50 mm in thickness through a rough rolling machine, or by producing a sheet bar of 5–50 mm in thickness through a sheet bar caster of two strands.

In the coil box 198, the sheet bar is little in the temperature drop and has a uniform temperature distribution, which is then fed to the subsequent large draft rolling machine 199.

The resulting steel sheet of 2–6 mm in thickness rolled in the large draft rolling machine 199 is continuously fed into the high speed rolling machine 200.

In the high speed rolling machine 200, the steel sheet is rolled at two four-high stands to obtain a high-grade hot rolled or processable thin steel sheet having a given thickness. In this case tension rolling may be performed between the two stands. The thus rolled thin steel sheet is taken up on the coiler 202.

In the devices 203 and 204, the lubricating oil and water are separately supplied to a jetting nozzle, from which they are jetted together to a work roll. In this case, the jetting nozzle is arranged so as to uniformly apply the lubricating oil to the surface of the work roll.

As described on the fourteenth and fifteenth embodiments according to the invention, the use of the coil box, large draft rolling machine and high speed rolling machine can omit the cold rolling step or cold rolling-annealing step in the production of processable thin steel sheets made from low carbon steel, stainless steel or the like. Further, the high productivity of the thin steel sheet can be obtained because of the high speed rolling. Moreover, since the rolling load is reduced owing to the lubrication rolling, the energy-saving and the compactness of the equipment are accomplished and the surface properties of the thin steel sheet are improved.

Figure 31:
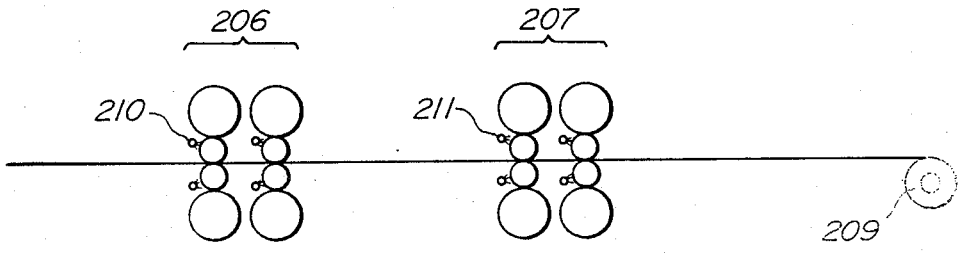
FIG. 31 is an elevational view of a sixteenth embodiment of the apparatus for producing the thin steel sheet according to the invention.
Figure 32:
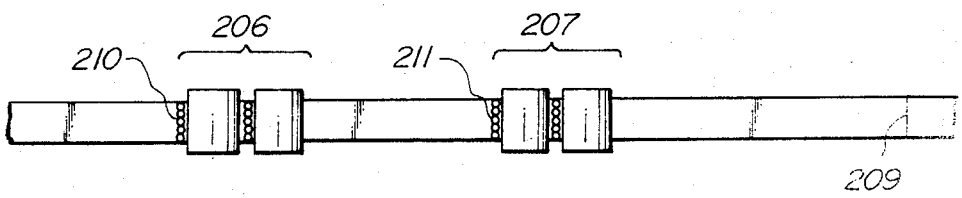
FIG. 32 is a plan view of FIG. 31.

In FIGS. 31 and 32 is shown a sixteenth embodiment of the apparatus for the production of thin steel sheets according to the invention, wherein numeral 206 is a large draft rolling machine of two four-high stands provided with a lubrication means and being capable of rolling at a draft of not less than 90%, and numeral 207 a high speed rolling machine provided with a lubrication means, which is capable of rolling at a rolling speed of up to 5,000 m/min at maximum (removing a decerator from the conventional rolling machine) and may perform low speed rolling. Further, numeral 209 is a coiler, and each of numerals 200 and 211 a device for jetting a lubricating oil.

The operation of the sixteenth embodiment will be described below. That is, a steel sheet or cast strip is continuously fed to the large draft rolling machine 206. The steel sheet or cast strip is obtained by shaping a slab cast from a continuous casting machine into a sheet bar of 10–50 mm in thickness through a rough rolling machine, or by producing a sheet bar of 5–50 mm in thickness through a sheet bar caster.

The resulting steel sheet of 2–6 mm in thickness rolled in the large draft rolling machine 206 is continuously fed into the high speed rolling machine 207.

In the high speed rolling machine 207, the steel sheet is rolled at two four-high stands to obtain a high-grade hot rolled or processable thin steel sheet having a given thickness. In this case, tension rolling may be performed between the two stands. The thus rolled thin steel seeet is taken up on the coiler 209.

In the devices 210 and 211, the lubricating oil and water are separately supplied to a jetting nozzle, from which they are jetted together to a work roll. In this case, the jetting nozzle is arranged so as to uniformly apply the lubricating oil to the surface of the work roll.

According to the sixteenth embodiment of the invention, the use of the large draft rolling machine 206 and high speed rolling machine 207 can omit the cold rolling step or cold rolling-annealing step in the production of processable thin steel sheets made from low carbon steel, stainless steel or the like. Further, the high productivity of the thin steel sheet can be obtained because of the high speed rolling. Moreover, since the rolling load is reduced owing to the lubrication rolling, the energy-saving and the compactness of the equipment are accomplished and the surface properties of the thin steel sheet are improved.

Figure 33:
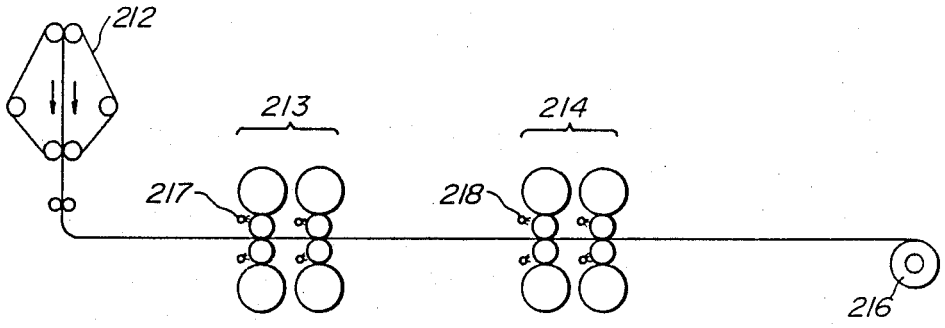
FIG. 33 is an elevational view of a seventeenth embodiment of the apparatus for producing the thin steel sheet according to the invention.
Figure 34:
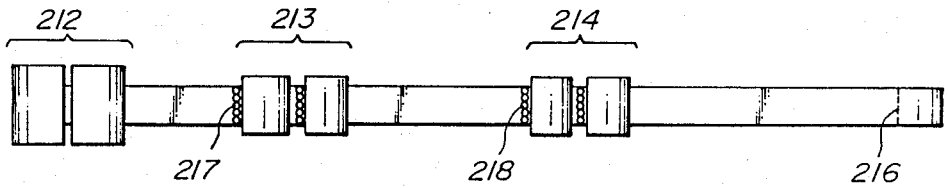
FIG. 34 is a plan view of FIG. 33.

In FIGS. 33 and 34 is shown a seventeenth embodiment of the apparatus for the production of thin steel sheets according to the invention. Numeral 212 is a continuous casting apparatus comprising a pair of endless steel belts each cooled at its surface with water for a strip caster process. These belts are vertically or slantly arranged side by side at a gap corresponding to a thickness of a steel sheet or cast strip to be cast and synchronously moved in a direction of arrow by means of a driving device (not shown). Numeral 213 is a large draft rolling machine of two four-high stands provided with a lubrication menns and being capable of rolling at a draft of not less than 90%, and numeral 214 a high speed rolling machine provided with a lubrication means, which is capable of rolling at a rolling speed of up to 5,000 m/min at maximum and may perform low speed rolling. Further, numeral 216 is a coiler, and each of numerals 217 and 218 a device for jetting a lubricating oil.

The operation of the seventeenth embodiment will be described below. That is, a steel sheet or cast strip of 5–50 mm in thickness produced from the continuous casting apparatus 212 is continuously fed to the large draft rolling machine 213. In this case, the cast strip may be cut into a proper length by means of a shear or may be endlessly supplied to the large draft rolling machine 213.

The resulting steel sheet of 2–6 mm in thickness rolled in the large draft rolling machine 213 is continuously fed into the high speed rolling machine 214.

In the high speed rolling machine 214, the steel sheet is rolled at two four-high stands to obtain a high-grade hot rolled or processable thin steel sheet having a given thickness. In this case, tension rolling may be performed between the two stands. The thus rolled thin steel sheet is taken up on the coiler 216.

In the devices 217 and 218, the lubricating oil and water are separately supplied to a jetting nozzle, from which they are jetted together to a work roll. In this case, the jetting nozzle is arranged so as to uniformly apply the lubricating oil to the surface of the work roll.

According to the seventeenth embodiment of the invention, the large draft rolling machine 213 and the high speed rolling machine 214 are arranged behind the continuous casting machine 212 for the strip caster process, whereby the cold rolling step or cold rolling-annealing step can be omitted in the production of processable thin steel sheets made from low carbon steel, stainless steel or the like. Further, the high productivity of the thin steel sheet can be obtained because of the high speed rolling. Moreover, since the rolling load is reduced owing to the lubrication rolling, the energy-saving and the compactness of the equipment are accomplished and the surface properties of the thin steel sheet are improved.

As mentioned above, according to the invention, when thin steel sheets having an improved processability are produced from the continuously cast material, the cold rolling step or cold rolling-annealing step can be omitted by subjecting the cast material to a lubrication rolling at a temperature of from $Ar_3$ transformation point to 300° C. and a high rolling speed of not less than 1,500 m/min. Further, the thin steel sheets having an improved processability can be produced while compacting the hot rolling step and omitting the cold rolling step or cold rolling-annealing step by subjecting the cast material to a strong lubrication rolling step at a temperature of 1,100°-700° C. under such a condition that the reduction rate of rolling load is not less than 30% and further to a lubrication rolling step at a temperature of from $Ar_3$ transformation point to 300° C. and a high rolling speed of not less than 1,500 m/min.

What is claimed is:

1. A method of producing thin steel sheets having an improved processability, comprising a combination of a continuous casting step, a rough rolling step and a lubrication rolling step at a temperature of from $Ar_3$ transformation point to 300° C. and a rolling speed of not less than 1,500 m/min.

2. The method according to claim 1 further comprising coiling the steel sheet in a coiler after said lubrication rolling step.

3. The method according to claim 1 further comprising coiling the steel sheet in a proximity coiler after said lubrication rolling step so as to reduce the temperature drop of the steel sheet and containing the steel sheet in an insulation box for maintaining the taken-up steel sheet within a temperature range of 750°-600° C. for a given time after said lubrication rolling step.

4. The method according to claim 1 further comprising coiling the steel sheet in a coil box before said rough rolling step.

5. The method according to claim 4 further comprising joining the steel sheet decoiled from said coil box by a sheet bar joining machine.

6. A method of producing thin steel sheets having an improved processability, comprising a combination of a continuous casting step, a rough rolling step, a finish hot rolling step and a lubrication rolling step at a temperature of from $Ar_3$ transformation point to 300° C. and a rolling speed of not less than 1,500 m/min.

7. The method according to claim 6 wherein said finish hot rolling step is carried out at a temperature of from 1,100° C. to 700° C. under such a strong lubrication that a reduction rate of rolling load is not less than 30%.

8. The method according to claim 6 further comprising passing the steel sheet through a cooling device between said finish hot rolling step and said lubrication rolling step.

9. The method according to claim 6, further comprising coiling the steel sheet in a coil box before said rough rolling step.

10. A method of producing thin steel sheets having an improved processability, comprising a combination of a step of directly and continuously producing a strip of not more than 50 mm in thickness from molten steel through a strip caster process and a lubrication rolling step at a temperature of from $Ar_3$ transformation point to 300° C. and a rolling speed of not less than 1,500 m/min.

11. The method according to claim 10 further comprising coiling the continuously cast strip in a coil box after said continuously strip producing step.

12. A method of producing thin steel sheets having an improved processability, comprising a combination of a step of directly and continuously producing a strip of not more than 50 mm in thickness from molten steel through a strip caster process, a finish hot rolling step and a lubrication rolling step at a temperature of from $Ar_3$ transformation point to 300° C. and a rolling speed of not less than 1,500 m/min.

13. The method according to claim 12, wherein said finish hot rolling step is carried out at a temperature of from 1,100° C. to 700° C. under such a strong lubrication that a reduction rate of rolling load is not less than 30%.

14. A method of producing thin steel sheets having an improved processability, comprising a combination of a continuous casting step, a rough rolling step, a lubrication rolling step at a temperature of from $Ar_3$ transformation point to 300° C. and a rolling speed of not less than 1,500 m/min and an annealing step.

15. The method according to claim 14 further comprising passing the steel sheet through a cooling device between said the lubrication rolling step and said annealing step.

16. A method of producing thin steel sheets having an improved processability, comprising a combination of a continuous casting strip, a rough rolling step, a finish hot rolling step, a lubrication rolling step at a temperature of from $Ar_3$ transformation point to 300° C. and a rolling speed of not less than 1,500 m/min and an annealing step.

17. The method according to claim 16, wherein said finish hot rolling step is carried out at a temperature of from 1,100° C. to 700° C. under such a strong lubrication that a reduction rate of rolling load is not less than 30%.

18. A method of producing thin steel sheets having an improved processability, comprising a combination of a step of directly and continuously producing a strip of not more than 50 mm in thickness from molten steel through a strip caster process, a lubrication rolling step at a temperature of from $Ar_3$ transformation point to 300° C. and a rolling speed of not less than 1,500 m/min and an annealing step.

19. A method of producing thin steel sheets having an improved processability, comprising a combination of a step of directly and continuously producing a strip of not more than 50 mm in thickness from molten steel through a strip caster process, a finish hot rolling step, a lubrication rolling step at a temperature of from $Ar_3$ transformation point to 300° C. and a rolling speed of not less than 1,500 m/min and an annealing step.

20. The method according to claim 19, wherein said finish hot rolling step is carried out at a temperature of from 1,100° C. to 700° C. under such a strong lubrication that a reduction rate of rolling load is not less than 30%.

* * * * *